US005785385A

United States Patent [19]

Lie et al.

[11] Patent Number: 5,785,385

[45] Date of Patent: Jul. 28, 1998

[54] LOCKING DEVICE FOR CHAIR SEATS

[76] Inventors: Tore Lie, N-2391, Moelv, Norway; Lars Holstensson, S. Koltorpsgatan 37, S-571 39 Nassjö , Sweden

[21] Appl. No.: 561,098

[22] Filed: Nov. 21, 1995

Related U.S. Application Data

[63] Continuation of Ser. No. 993,528, Dec. 18, 1992, abandoned, which is a continuation of Ser. No. 640,311, filed as PCT/MO89/00078 Jul. 27, 1989, abandoned.

[30] Foreign Application Priority Data

Jul. 27, 1988 [NO] Norway ..... 883319

[51] Int. Cl.[6] ..... A47C 1/02

[52] U.S. Cl. ..... 297/328

[58] Field of Search ..... 297/328, 313, 297/316, 314, 337, 374, 311, 325, 326, 327, 331, 335, 336

[56] References Cited

U.S. PATENT DOCUMENTS 3,602,546 8/1971 Tabor ..... 297/374
4,198,094 4/1980 Bjerknes et al. ..... 297/328 X
4,478,454 10/1984 Faiks ..... 297/328 X
4,636,004 1/1987 Neumüller ..... 297/313 X

FOREIGN PATENT DOCUMENTS 7707623 1/1979 Switzerland ..... 297/327

*Primary Examiner*—Milton Nelson, Jr.
*Attorney, Agent, or Firm*—Jack Shore; Hamman & Benn

[57] ABSTRACT

Device for locking in a chair seat in a desired angular position, comprising several lamellae (1) connected with the seat, extending through a retainer (7) and between fixed lamellae (2) arranged in the retainer, whereby clamping shoes (3, 4) which are abutting against the outer fixed lamellae (2) may be clamped by bolts (5, 6) for locking the position of the seat and providing possibility for adjustment of the clamping points of the bolts, where lameellae (1) without holes are arranged abutting against fixed lamellae (2) across their width, the lamellae (1) being connected with the seat of the chair, the fixed lamellae (2) being captured by the retainer (7) and the bolts (5, 6), each provided with a clamping shoe (3, 4) and aligned axially.

2 Claims, 1 Drawing Sheet

LOCKING DEVICE FOR CHAIR SEATS

This is a continuation of application Ser. No. 07/993,528, filed Dec. 18, 1992, now abandoned, which is a continuation of application Ser. No. 07/640,311, filed as PCT/MO89/00078 Jul. 27, 1989, now abandoned.

The present invention is related to a locking device for a chair seat having an adjustable angle according to the preamble of the claim.

Several principles are known for adjusting and locking the angular position of seats, especially of office chairs. For a long time it already has been known to use arcuated lamellae secured to the underside of the seat and guided between lamellae blocks in a retainer which again is secured to the base of the chair, whereby a bolt extends through a centric hole in the lamellae block and a slot in all lamellae. Locking of the seat in a desired position was provided by clamping the lamellae and the lamellae block together whereby the abutment surface which was necessary to achieve sufficient friction in relation to the force from the locking mechanism, was provided by the width of the lamella on both sides of the slots as well as their number.

In known embodiments the width or the number of lamellae must be greater due to the slot, thereby to achieve the necessary friction surface in relation to the force which can be expected in connection with the clamping. Additionally manufacturing of the slots in the lamellae and the hole in the fixed lamellae made necessary an additonal operation in the production. Also the assembling consumed additional time for bringing the bolt through the holes in the fixed lamellae and the slots for clamping the lamellae against a fixed abutment. No consideration was made as to tolerances in the production in connection with the assembling of the lamellae.

With the locking device according to the present invention the above mentioned disadvantages by known corresponding devices are avoided and there is provided a possibility for adjustment of a desired position of the lamellae in the retainer as well as a possibility for later adjustment of the position, of the operation handle when the locking device is brought into clamping position. These advantages are achieved with the locking device according to the invention as described with the features stated in the claim.

Figure 1:
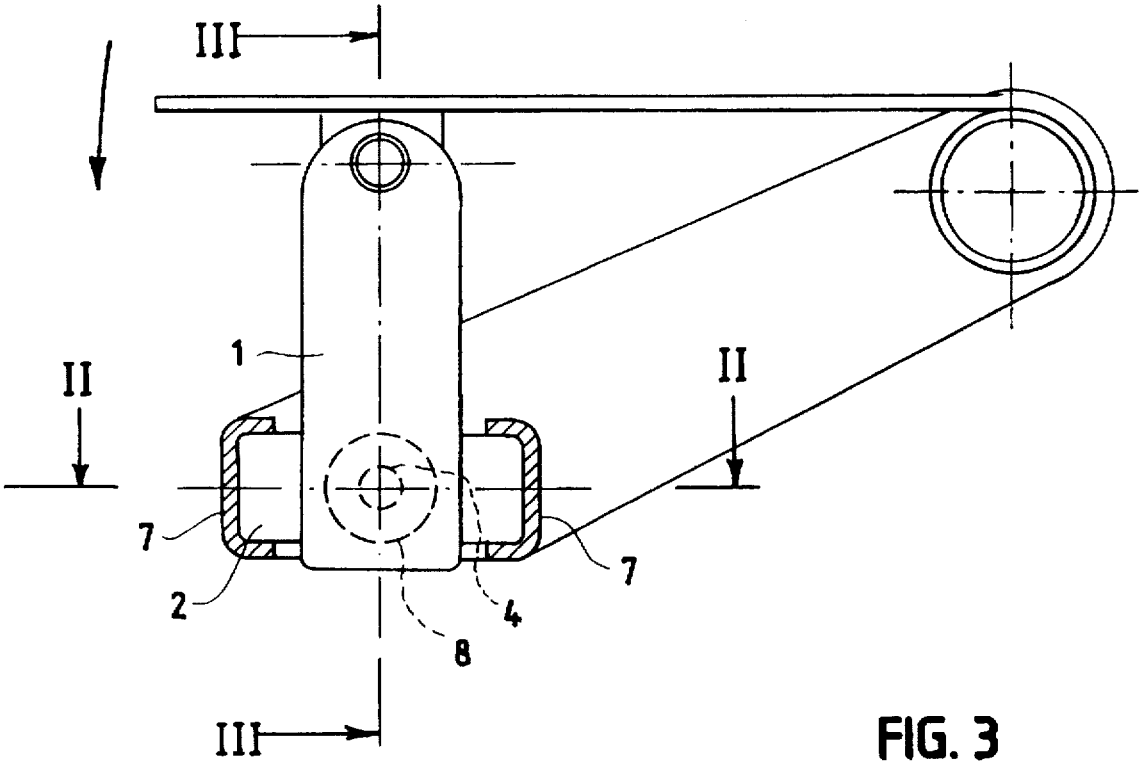
Figure 3:
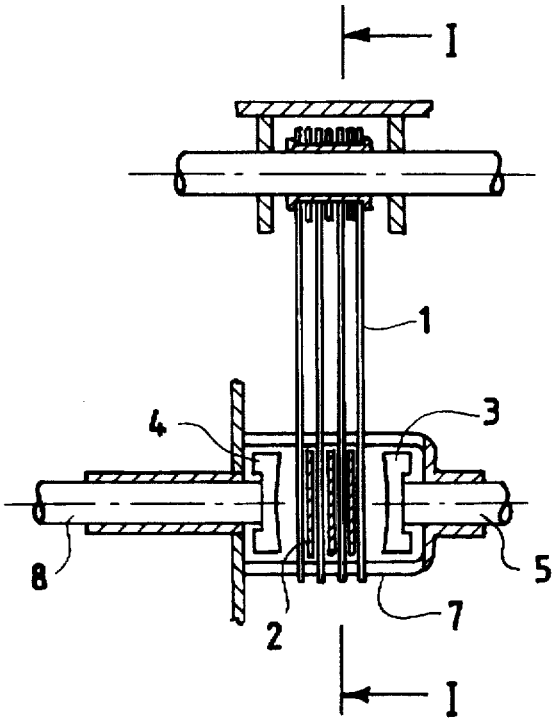
Figure 2:
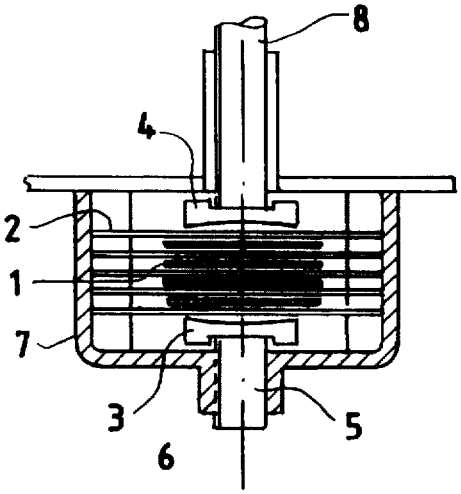

In the drawing FIG. 1 discloses a section along I—I in FIG. 3, FIG. 2 discloses a section along II—II in FIG. 1 and FIG. 3 discloses a view from the right side in FIG. 3.

Several arcuated lamellae 1 are secured to the underside of a chair seat and protude through a retainer 7 secured to the base of the chair through its connection to plate 12. In the retainer are arranged retaining lamellae in such a way that all arcuated lamellae 1 are kept between fixed lamellae. The fixed lamellae 2 are provided with recesses to be received by the side edges of the retainer 7 in such a way that the lamellae 2 are captured in the retainer 7. Against both sides of the lamella package are arranged preferably a cup shaped clamping shoe 3, 4 abutting with preferably an annular surface against a retaining lamella 2. A bolt 5 is arranged through a hole in the retainer 7 and connected with the clamping shoe 3 in such a way that the clamping shoe 3 by turning of the bolt 5 may be displaced against or away from the fixed lamella 2. Upon desired adjustment of the bolt 5 by means of schematically illustrated threads 6, the bolt may be secured with a nut (not shown).

Against the opposite side of the lamella package a clamping shoe 4 is abutting against the lamella 2 whereby a schematically illustrated threaded bolt 8 is releasably connected with the clamping shoe 4 and threaded through a hole in the retainer 7. The bolt 8 is conveniently is extended to the side of the chair and a operation arm is secured to the end of the bolt 8 suitably in a place for operation by the user. Turning of the operation arm will press the clamping shoe 4 against the lamella 2.

By adjustment of the bolt 5 the locking device may be adjusted upon wear of the lamella and a desired position of the operation arm may be achieved by adjustment. In the same way desired position of the lamellae in the retainer may be adjusted by adjusting the bolts 5 and 8 along the axis 14.

We claim:

1. A device for locking a chair base of a chair seat in a desired angular position comprising a plurality of first lamellae adapted to be connected to the chair base, a retainer having side edges adapted to be secured to the chair base containing a plurality of second lamellae interspersed with the first lamellae, the first and second lamellae defining adjacent contacting surfaces containing no openings or slots, adjustable clamping means comprising adjustable clamping shoes affixed to bolt means that extend through and are threadably connected to said retainer for clamping together the adjacent contacting surfaces of said first and second lamellae for locking the chair seat at the desired angle relative to the chair base.

2. A device as set forth in claim 1 in which the bolt means are in coaxial relationship.

* * * * *